US005110053A

United States Patent [19]

Stevens

[11] Patent Number: 5,110,053

[45] Date of Patent: May 5, 1992

[54] FUEL INJECTION NOZZLE

[75] Inventor: John W. Stevens, Kent, England

[73] Assignee: Lucas Industries Public Limited Company, Solihull, England

[21] Appl. No.: 624,322

[22] Filed: Dec. 4, 1990

[30] Foreign Application Priority Data

Apr. 12, 1990 [GB] United Kingdom ..... 9008403

[51] Int. Cl.[5] ..... F02M 61/12

[52] U.S. Cl. ..... 239/533.9; 239/533.11; 239/533.12

[58] Field of Search ..... 239/533.2, 533.3, 533.4, 239/533.9, 533.11, 533.12, 584

[56] References Cited

U.S. PATENT DOCUMENTS

| | | | |
|---|---|---|---|
| 2,110,365 | 3/1938 | Imfield | 239/584 X |
| 3,368,761 | 2/1968 | Pelizzoni | 239/533.4 |
| 4,470,548 | 9/1984 | Ushimura | 239/533.3 |
| 4,506,833 | 3/1985 | Yoneda et al. | 239/533.4 |
| 4,836,454 | 6/1989 | Gaskell | 239/533.9 |
| 4,974,565 | 12/1990 | Hashimoto et al. | 239/533.12 X |
| 4,981,267 | 1/1991 | Scott | 239/533.9 X |

*Primary Examiner*—Andres Kashnikow
*Assistant Examiner*—William Grant
*Attorney, Agent, or Firm*—Dvorak and Traub

[57] ABSTRACT

A fuel injection nozzle has a body in which is formed a bore at one end of which is a seating. Outlet orifices extend from the bore and located in the bore is a valve member shaped at one end to engage the seating and spring biased into engagement with the seating to prevent fuel flow through the orifices. The initial movement of the valve member away from the seating is limited and during this limited movement the fuel flow through the orifices is limited by an annular clearance defined by axially extending cylindrical surfaces formed by the wall of the bore and the valve member.

8 Claims, 1 Drawing Sheet

FUEL INJECTION NOZZLE

This invention relates to fuel injection nozzles for supplying liquid fuel to a compression ignition engine and of the kind comprising a nozzle body defining a blind bore, an annular seating defined at the blind end of the bore, a valve member movable axially in the bore, the valve member being shaped for co-operation with the seating, a high pressure fuel inlet communicating with a space defined between the valve member and the wall of the bore, resilient means biasing the valve member into engagement with the seating, the valve member being movable by fuel under pressure away from the seating to allow flow of fuel through an outlet orifice extending from the bore downstream of the seating, and means to limit the initial movement of the valve member away from the seating so that the initial flow of fuel through the orifice is at a restricted rate.

Fuel injection nozzles of the aforesaid type are well known in the art and the reason for supplying the initial flow of fuel at a restricted rate is to control the rate of rise of pressure in the combustion chamber of the engine with which the nozzle is associated. In the prior art nozzles the restrictor which restricts the flow of fuel is formed by a small gap between the valve member and the seating and the setting of this gap is determined by stop surfaces which are located at a position removed from the seating. The setting of the stop surfaces requires great care in order to achieve the desired initial rate of flow of fuel and the setting in the use of the nozzle can be easily upset by for example excessive tightening of the clamp which secures the nozzle to the cylinder head of the engine.

The object of the present invention is to provide a fuel injection nozzle of the kind specified in a simple and convenient form.

According to the invention in a fuel injection nozzle of the kind specified the wall of the bore and the valve member are shaped to form cooperating clearance forming surfaces defining an axially extending clearance which is positioned upstream of the seating and which forms a restrictor which acts to restrict the initial flow of fuel through the orifice, said cooperating clearance forming surfaces separating as the valve member moves to the fully open position to allow substantially unrestricted flow of fuel through the outlet orifice.

An example of a fuel injection nozzle in accordance with the invention will now be described with reference to the accompanying drawings in which.

Figure 1:
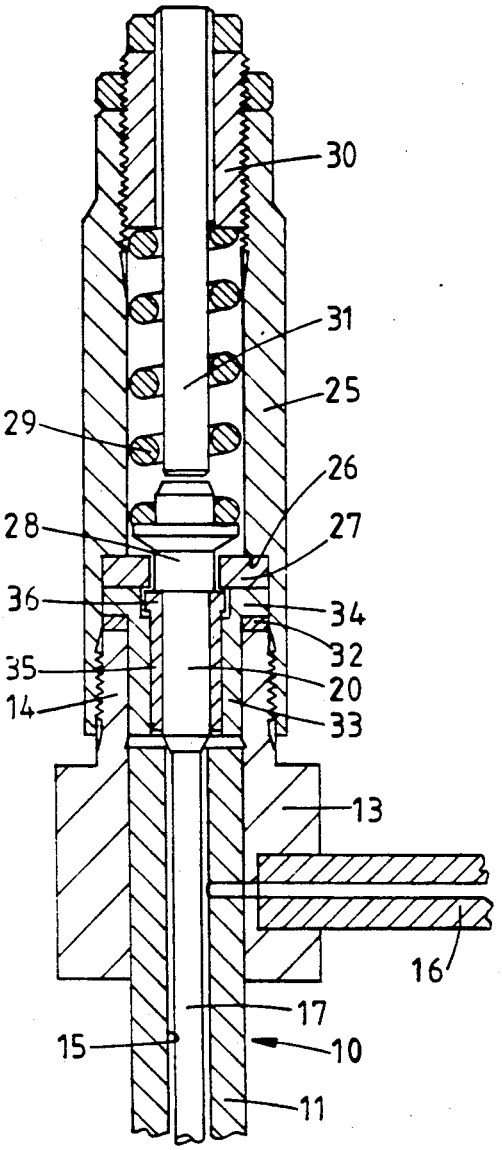
FIG. 1 is a sectional side elevation through part of a fuel injection nozzle.
Figure 2:
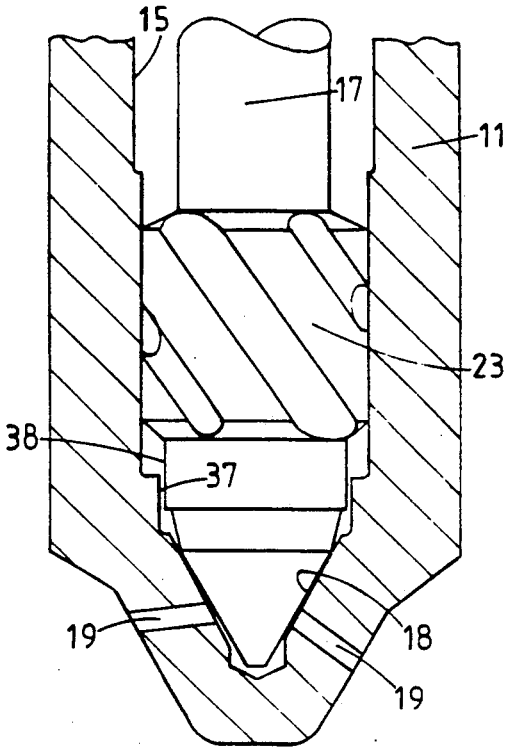
FIG. 2 is a view to an enlarged scale of the part of the nozzle not seen in FIG. 1

Referring to FIGS. 1 and 2 of the drawings the nozzle comprises a multi-part body 10 having a main cylindrical portion 11 including a mounting 13 which extends about the cylindrical portion 11 and is secured thereto in any convenient manner. The mounting 13 defines a hollow cylindrical boss 14 which is provided with a peripheral screw thread.

Extending within the portion 11 is a blind bore 15 and communicating with the bore is a fuel inlet 16 which in use is connected to the outlet of a fuel injection pump. Defined at the blind end of the bore 15 is a seating 18 and located within the bore is a valve member 17 which is shaped at one end for cooperation with the seating. In the closed position of the valve member flow of fuel from the inlet 16 through the outlet orifices 19 is prevented and furthermore, in the example, the valve member closes the inner ends of the orifices since the latter extend from the seating.

The valve member 17 extends out of the bore 15 and the extended portion 20 of the valve member is of enlarged diameter and is slidably located within an inner guide bush 35 which has a flange 36, the guide bush 35 itself being slidable within an outer guide bush 33 having a flange 34. The flange 34 overlies the end of the boss 14 and the diameter of the outer guide bush 33 is slightly smaller than the internal diameter of the boss.

The valve member 17 is also guided for movement adjacent the seating by the provision of a fluted collar 23 which is in sliding engagement with a portion of the wall of the bore 15.

Engaged with the boss 14 is a tubular member 25 in the internal surface of which there is defined a step 26 against which is located a thrust plate 27 which is engaged with the flanged end of the bush 33 and is engagable by the flanged end of the inner guide bush 35. The thrust plate is provided with a central aperture through which extends into contact with the portion 20 of the valve member, a spring abutment 28 against which is located one end of a coiled compression spring 29. The spring abutment is also engagable by the flanged end of the inner guide bush 35. The other end of the spring engages an adjuster 30 which is adjustably mounted in the tubular member 25 and the adjuster carries a stop member 31 which extends within the spring 29 and is engagable by the spring abutment 28 to limit the maximum extent of movement of the valve member in the use of the nozzle.

The valve member 17 is guided at two spaced positions and in the closed position of the valve member it is essential that it forms a fuel tight seal with the seating. In order to accommodate any misalignment, the bush 33 can move laterally a limited extent within the boss 14 and therefore during assembly of the nozzle the valve member is inserted into the bore and engaged with the seating following which the tubular member is tightened onto the boss. The clamping force which is generated urges the thrust plate 27 against the flanged end of the bush 33 and the flange 34 of the bush is urged against the end wall of the boss 14. A fuel tight seal is obtained between the flange 34 and the boss 14 this being facilitated by the provision of a soft metal washer 32.

In operation, when fuel under pressure is supplied to the bore 15 the pressure acts upon the valve member 17 and also upon the end surface of the bush 35. The fuel pressure acting upon the bush 35 will move it into engagement with the spring abutment thereby to assist the movement of the valve member away from the seating. Since the movement of the bush 35 is limited by its engagement with the thrust plate 27, the initial movement of the valve member will also be limited The limited extent of movement of the valve member permits fuel flow to the associated engine at a restricted rate but as the fuel pressure at the inlet increases, the valve member will eventually move its maximum extent against the action of the spring so that the fuel flow to the associated engine will be at a substantially unrestricted rate.

The flow of fuel at a restricted rate is controlled by a restrictor which is formed by clearance forming surfaces, 37, 38 formed on the valve member downstream of the collar 23, and the bore 15 respectively. The surfaces define an axially extending annular clearance the radial dimension of which can be readily determined during manufacture of the nozzle. Although the degree of restriction to the flow of fuel does depend upon the extent of axial overlap of the surfaces, the degree of restriction is much less sensitive to variations in the position of the stop surfaces which determine the initial movement of the valve member, than is the case where the restrictor to the flow of fuel is formed by the gap between the valve member and the seating. It is thereby easier to adjust the stop surfaces i.e. the gap between the flange 36 of the inner guide bush and the thrust plate 27, and furthermore any slight variations in the gap which occur when the nozzle is in use has a reduced influence on the flow of fuel at the restricted rate.

Figure 3:
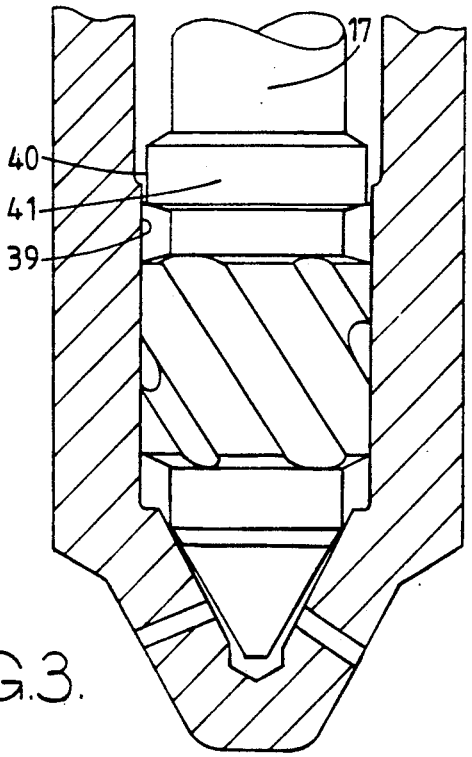
FIG. 3 is a view similar to FIG. 2 showing a modification.

FIG. 3 shows an alternative arrangement in which the clearance forming surfaces are located upstream of the collar 23 being defined by a surface 39 of a portion of the bore and a surface 40 formed on a further collar 41 of the valve member.

I claim:

1. A fuel injection nozzle for supplying fuel to a compression ignition engine comprising an elongated nozzle body defining a blind bore, an annular seating defined at the blind end of the bore, a hollow boss defined at the end of the body remote from the seating, a valve member movable axially within the bore and defining a space with the wall of the bore, the valve member being shaped at one end for engagement with the seating and having its other end projecting from the bore and extending within said boss, a fuel inlet communicating with said space, resilient means biasing the valve member into engagement with the seating, the valve member being movable by fuel pressure away from the seating to allow fuel flow through an outlet orifice extending from the bore downstream of the seating, an inner guide bush surrounding the portion of the valve member within said boss, said inner guide bush serving to guide the movement of the valve member, an outer guide bush in which the inner guide bush is axially slidable, an outwardly extending flange formed on the outer guide bush, said flange overlying an annular end surface of said boss, a washer interposed between said end surface and said flange, means engagable with said boss to clamp the washer and flange to said surface to achieve a fuel tight seal, a clearance defined between an inner surface of said boss and another surface of said outer guide bush, whereby prior to clamping the washer and flange to said surface the outer guide bush can be positioned laterally to achieve alignment of the valve member, cooperating surfaces defined by the valve member and the wall of the bore respectively, said cooperating surfaces forming a restrictor which acts to restrict the flow of fuel between the fuel inlet and the outlet orifice during the initial movement of the valve member away from the seating, said cooperating surfaces separating as the valve member moves to the fully open position to allow substantially unrestricted flow of fuel and a stop to determine the fully open position of the valve member.

2. A nozzle according to claim 1 including a spring abutment engaged with the other end of the valve member and being engagable by said inner bush whereby fuel under pressure from said fuel inlet acts on said inner bush, and a thrust plate engagable by said inner bush to limit the movement thereof under the action of fuel pressure.

3. A nozzle according to claim 2 in which said thrust plate is interposed between said flange and a step defined in the internal surface of a tubular member in screw thread engagement with said boss, said tubular member providing a housing for a spring which forms said resilient means and is in engagement with said spring abutment.

4. A nozzle according to claim 3 in which said tubular member carries an adjuster for said spring and a stop member which is engagable with said spring abutment and forms said stop.

5. A nozzle according to claim 1 in which said cooperating surfaces are of cylindrical form and the restrictor is formed by an annular clearance between the surfaces.

6. A nozzle according to claim 5 including a fluted collar on the valve member adjacent said one end thereof, said collar engaging with the wall of the bore to guide the movement of said one end of the valve member.

7. A nozzle according to claim 6 in which said cooperating surfaces are positioned intermediate the collar and the fuel inlet.

8. A nozzle according to claim 6 in which said cooperating surfaces are positioned intermediate the collar and the seating.

* * * * *